US010506908B2

(12) United States Patent
Anim-Mensah et al.

(10) Patent No.: US 10,506,908 B2
(45) Date of Patent: Dec. 17, 2019

(54) BATCH-TYPE WAREWASHER WITH ENERGY RETAINING CURTAIN

(71) Applicant: ILLINOIS TOOL WORKS INC., Glenview, IL (US)

(72) Inventors: Alexander R. Anim-Mensah, Centerville, OH (US); Mary E. Paulus, Sidney, OH (US); Michael T. James, Dayton, OH (US); Zachary Siefker, Elida, OH (US); Prasanna Venkatesh Murlidharan, Dayton, OH (US); Bandr Mohsin Alsubaie, Dammam (SA); Zaid Azmathullah Shaikh, Dayton, OH (US); Daryl Michael Osterloh, Dayton, OH (US); Adam Puccetti, Pittsburgh, PA (US); Tarik Said Mohammed Alkharusi, Muscat (OM)

(73) Assignee: ILLINOIS TOOL WORKS INC., Glenview, IL (US)

( * ) Notice: Subject to any disclaimer, the term of this patent is extended or adjusted under 35 U.S.C. 154(b) by 194 days.

(21) Appl. No.: 15/653,828

(22) Filed: Jul. 19, 2017

(65) Prior Publication Data

US 2018/0020899 A1 Jan. 25, 2018

Related U.S. Application Data

(60) Provisional application No. 62/365,463, filed on Jul. 22, 2016.

(51) Int. Cl.
*A47L 15/00* (2006.01)
*A47L 15/42* (2006.01)

(52) U.S. Cl.
CPC ..... *A47L 15/0076* (2013.01); *A47L 15/0078* (2013.01); *A47L 15/0081* (2013.01);
(Continued)

(58) Field of Classification Search
CPC combination set(s) only.
See application file for complete search history.

(56) References Cited

U.S. PATENT DOCUMENTS 1,156,424 A 10/1915 Murray
3,788,460 A 1/1974 Messersmith
(Continued)

FOREIGN PATENT DOCUMENTS

CN 203576454 5/2014
DE 202009003784 5/2009

OTHER PUBLICATIONS

PCT, International Search Report and Written Opinion, International Application No. PCT/US2017/042720; dated Nov. 6, 2017, 14 pages.

*Primary Examiner* — Erin F Bergner
(74) *Attorney, Agent, or Firm* — Thompson Hine LLP

(57) ABSTRACT

A batch-type warewash machine includes a chamber for receiving wares to be cleaned, the chamber having a chamber access opening and a single spray zone, with at least one spray system for spraying liquid onto wares in the single spray zone. A door is movable between a closed position covering the chamber access opening and an open position away from the chamber access opening to allow wares to be moved in and out of the chamber. A curtain structure is mounted on the machine, the curtain structure located behind the door when the door is in the closed position. The curtain structure remains in position and at least partially covers the chamber access opening when the door is in the open position so as to retain hot moist air within the chamber when the door is moved to the open position upon completion of a ware cleaning cycle.

14 Claims, 4 Drawing Sheets

(52) U.S. Cl.
CPC ..... *A47L 15/4209* (2016.11); *A47L 15/4251* (2013.01); *A47L 15/4257* (2013.01); *A47L 2401/26* (2013.01); *A47L 2401/34* (2013.01); *A47L 2501/26* (2013.01); *A47L 2501/32* (2013.01)

(56) References Cited

U.S. PATENT DOCUMENTS 4,825,887 A 5/1989 Nezworski
4,832,064 A * 5/1989 Nezworski ..... A47L 15/243 134/146
5,202,582 A 4/1993 Szynal
5,464,032 A 11/1995 Litterst
5,630,438 A 5/1997 Hoover et al.
6,151,905 A 11/2000 Smith
6,918,398 B2 7/2005 Edelmann et al.
7,021,322 B2 4/2006 Kramer et al.
7,314,188 B2 1/2008 Watson et al.
7,350,528 B2 4/2008 Brunswick
8,157,924 B2 4/2012 Warner et al.
8,192,558 B2 6/2012 Warner
8,215,323 B2 7/2012 Kramer et al.
8,226,778 B2 7/2012 Kramer
8,252,121 B2 8/2012 Brunswick et al.
8,500,917 B2 8/2013 Kramer
8,663,395 B2 3/2014 Warner et al.
8,679,261 B2 3/2014 Brunswick et al.
2010/0269863 A1 10/2010 Disch
2011/0005551 A1 1/2011 Berner et al.
2011/0005557 A1 1/2011 Braun et al.
2011/0017235 A1 1/2011 Berner et al.
2011/0017240 A1 1/2011 Berner et al.
2011/0056520 A1 3/2011 Varacins et al.
2011/0132408 A1 6/2011 Disch et al.
2011/0139186 A1 6/2011 Disch et al.
2011/0203616 A1 8/2011 Berner et al.
2013/0240001 A1 9/2013 Padtberg et al.
2013/0319828 A1 12/2013 Disch et al.
2014/0034088 A1 2/2014 Padtberg et al.
2014/0102485 A1* 4/2014 Abdulfattah ..... A47L 15/0094 134/25.2
2015/0173587 A1 6/2015 Firchau et al.
2015/0216388 A1* 8/2015 Bewley, Jr. ..... A47L 15/0049 134/25.2

* cited by examiner

BATCH-TYPE WAREWASHER WITH ENERGY RETAINING CURTAIN

TECHNICAL FIELD

This application relates generally to warewashers such as those used in commercial applications in the nature of cafeterias and restaurants and, more particularly, to a batch-type warewasher with enhanced energy savings.

BACKGROUND

Commercial warewashers commonly include a housing area which defines a chamber for washing and rinsing of dishes, pots, pans and other wares. In a typical batch-type machine, such as an undercounter machine, a single cleaning zone or spray zone is provided in the machine and loads of wares are moved into and out of the machine through an opening that is closable by a door, with the ware remaining stationary in the spray zone during the cleaning cycle of the machine. In the commercial environment, ware loads are often cleaned sequentially one after the other, with personnel opening the machine door promptly after completion of a cleaning cycle so that the clean load of wares (e.g., in a removable and transportable rack) can be removed and a new load of soiled wares (e.g., in a different rack) can be inserted for initiation of a next cleaning cycle. This type of operation can result in significant energy losses in the form of warm, moist air that escapes the chamber when the door is opened at the end of a cycle. The heat and moisture transferred into the surrounding room also increases the amount of conditioning required to maintain a comfortable working environment in the kitchen.

It would be desirable to provide a simple arrangement for retaining some of the warm moist air within the chamber during load changes so as to reduce energy losses.

SUMMARY

In one aspect, a batch-type warewash machine for washing wares (e.g., dishes, glasses, pots, pans etc.) includes a chamber for receiving wares to be cleaned, the chamber having a chamber access opening and a single spray zone, with at least one spray system for spraying liquid onto wares in the single spray zone. A door is movable between a closed position covering the chamber access opening and an open position away from the chamber access opening to allow wares to be moved in and out of the chamber. A curtain structure is mounted on the machine, the curtain structure located behind the door when the door is in the closed position. The curtain structure remains in position and at least partially covers the chamber access opening when the door is in the open position so as to retain hot moist air within the chamber when the door is moved to the open position upon completion of a ware cleaning cycle.

In another aspect, a batch-type warewash machine includes a housing defining a chamber for receiving wares to be cleaned and having a chamber access opening through which wares are moved into and out of the chamber, the chamber including a lower sump zone and an upper spray zone. A wash spray system includes a pump and a wash liquid flow path for moving wash liquid from the sump along the wash liquid flow path to at least one wash spray arm with multiple wash spray nozzles for directing wash liquid sprays onto wares within the upper spray zone. A rinse spray system includes a rinse spray flow path for delivering rinse liquid to at least one rinse arm with multiple rinse spray nozzles for directing rinse liquids sprays onto wares within the upper spray zone. A door is mounted to the housing, the door movable between a closed position covering the chamber access opening and an open position away from the chamber access opening to allow wares to be moved in and out of the chamber. A curtain structure is mounted on the housing at the chamber access opening, the curtain structure positioned behind the door when the door is in the closed position. The curtain structure at least partially covers an upper part of the chamber access opening when the door is in the open position, the curtain structure including a flexible material that enables wares to be moved in and out of the chamber access opening past the curtain structure.

The details of one or more embodiments are set forth in the accompanying drawings and the description below. Other features, objects, and advantages will be apparent from the description and drawings, and from the claims.

DETAILED DESCRIPTION

Figure 1:
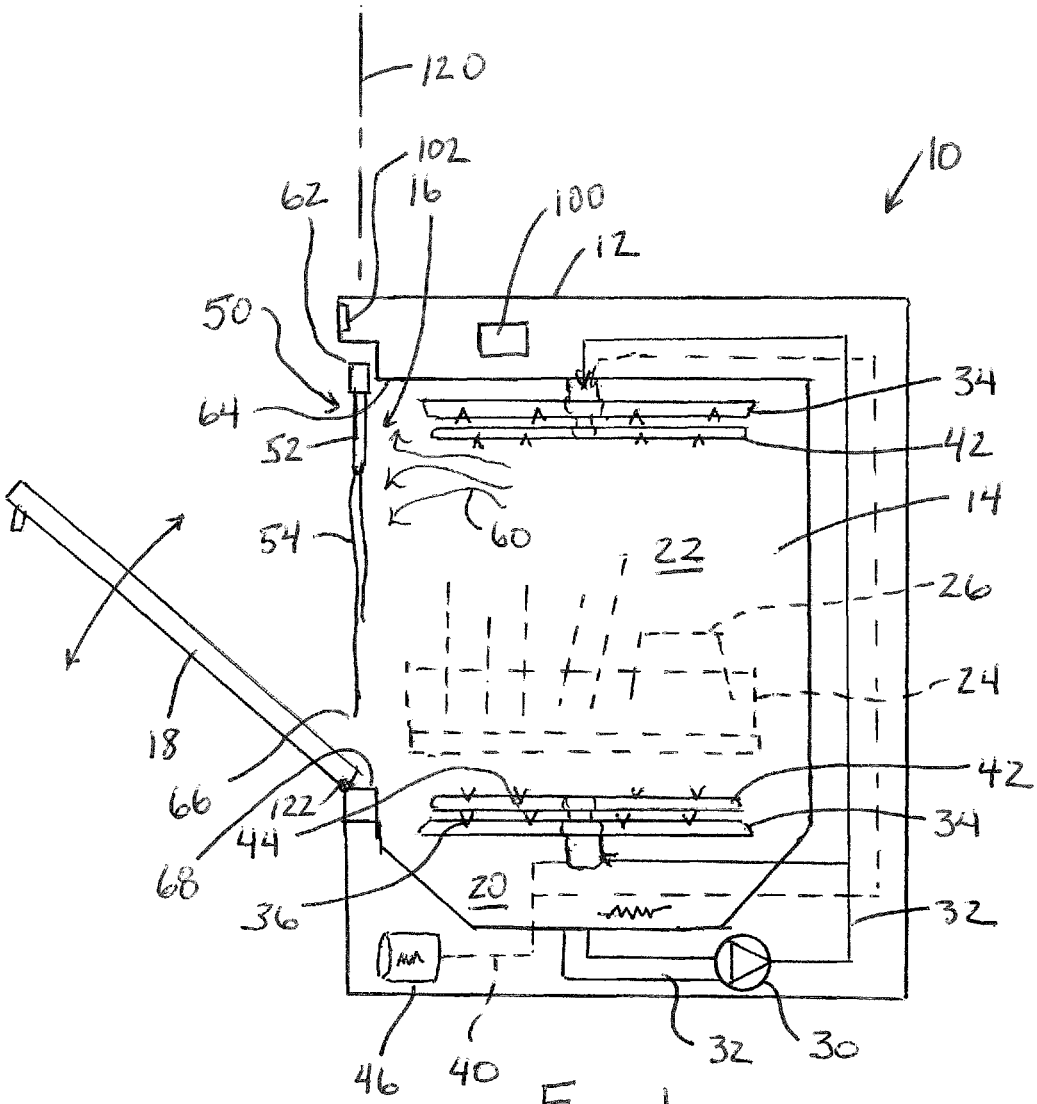
FIG. 1 is a schematic side elevation of one embodiment of a warewasher.

Referring to FIG. 1, an exemplary batch-type warewash machine, generally designated 10, is shown. Warewash machine 10 has a housing 12 that defines an internal chamber 14 that can receive loads of soiled wares through a chamber access opening 16 (e.g., at a front side of the machine) that is closeable by a door 18. The chamber 14 includes a lower sump zone 20 and an upper spray zone 22. Typically, wares are loaded into removable and transportable racks that are supported in the upper spray zone 22 during cleaning cycles, and an exemplary rack 24 with wares 26 is shown in dashed line form in FIG. 1. The rack 24 may, for example, be supported on side rims or rails that are part of the walls or the chamber.

The machine 10 includes a wash spray system including a pump 30 and a wash liquid flow path 32 for moving wash liquid from an outlet of the sump along the wash liquid flow path 32 to one or more wash spray arms 34 (here both upper and lower arms) having wash spray nozzles 36 for directing wash liquid sprays onto wares within the upper spray zone 22 (e.g., the upper arm sprays are directed downward toward ware rack 24 and the lower arm sprays are directed upward toward ware rack 24). Wash spray arms 34 may, for example, be of the rotatable type, but stationary arms are also possible.

The machine includes a rinse spray system including a rinse spray flow path 40 for delivering rinse liquid to at least one rinse arm 42 (here both upper and lower arms) with multiple rinse spray nozzles 44 for directing rinse liquids sprays onto wares within the upper spray zone 22. The rinse liquid may be hot fresh rinse water (with or without rinse agent) that is fed (e.g., either under line pressure or via a pump) to the rinse arms from a booster heater 46 during the rinse portion of a cleaning cycle.

During a typical cleaning process sprayed wash liquid is collected in the sump zone 20 and recirculated to the wash arms 34 via the pump 30 during the wash portion of the cycle. The wash portion, which may be for a programmed duration, may be followed by the rinse portion of the cleaning cycle. In some machines, a heated air delivery step may also be incorporated as a drying portion of the cleaning cycle at the end of the cleaning cycle.

The door 18 is movable between a closed position covering the chamber access opening and an open position away from the chamber access opening to allow wares to be moved in and out of the chamber. In the embodiment of FIG. 1 a bottom portion of the door 18 is pivotably mounted to the housing 12 such that the door 18 pivots downward in order to move from the closed position, which is an upright position, to the open position, which is a lateral position.

As shown, a curtain structure 50 is mounted on the housing 12 at the chamber access opening 16. The curtain structure is positioned behind the door 18 when the door is in the closed position. In certain implementations the curtain structure may typically be within six inches (e.g., within four inches) of the back or interior side of the door when the door is closed. The curtain structure 50 at least partially covers an upper part of the chamber access opening 16 when the door 18 is in the open position. Thus, the curtain structure does not move out of its covering position when the door is opened. The curtain structure 50 includes at least some flexible material that enables wares to be moved in and out of the chamber access opening past the curtain structure, with the curtain structure returning to its generally vertical orientation under the weight of gravity and/or aided by another rigid support which is part of the curtain assembly overlapping with part of the flexible material and located close to the upper portion of the curtain structure (per FIG. 5).

In the illustrated embodiment, the curtain structure 50 includes an upper rigid portion 52 (e.g., of plate or rod material) and a lower flexible portion 54 (e.g., of multiple elongated strands of flexible material), where the flexible portion 54 allows loads of ware to move in and out of the chamber 12. The flexible strands may be as staggered and overlapping layers with same lengths or varying lengths. As shown, when the door is open the curtain structure 50 substantially blocks a majority of flow of warm, moist air 60 in the upper part of the chamber 14 from exiting the chamber through the access opening 16.

In the illustrated embodiment, the curtain structure 50 extends downward from an upper position 62 proximate an upper edge 64 of the chamber access opening 16 (e.g., no more than four inches below the upper edge) and terminates at a lower position 66 that is higher than a bottom edge 68 of the chamber access opening 16. For example, position 62 may be at least four inches higher than bottom edge 68 (e.g., at least five inches higher or at least six inches higher). However, variations in which the position 62 is proximate the bottom edge 68 (e.g., less than four inches higher than the bottom edge) are also possible.

Notably, the batch-type machine 10 can be distinguished from typical conveyor style warewash machines in that in the machine 10 the chamber 14 lacks any opening, other than the chamber access opening 16, through which wares can be moved into and out of the chamber, the chamber 14 lacks any ware conveyance structure that moves wares during cleaning cycles (i.e., the ware rack 24 is stationary during the cleaning cycle), and the chamber 14 lacks any spray zone, other than the upper spray zone 22, with both wash liquid sprays and rinse liquid sprays are directed onto wares that are stationary within the upper spray zone.

Figure 2:
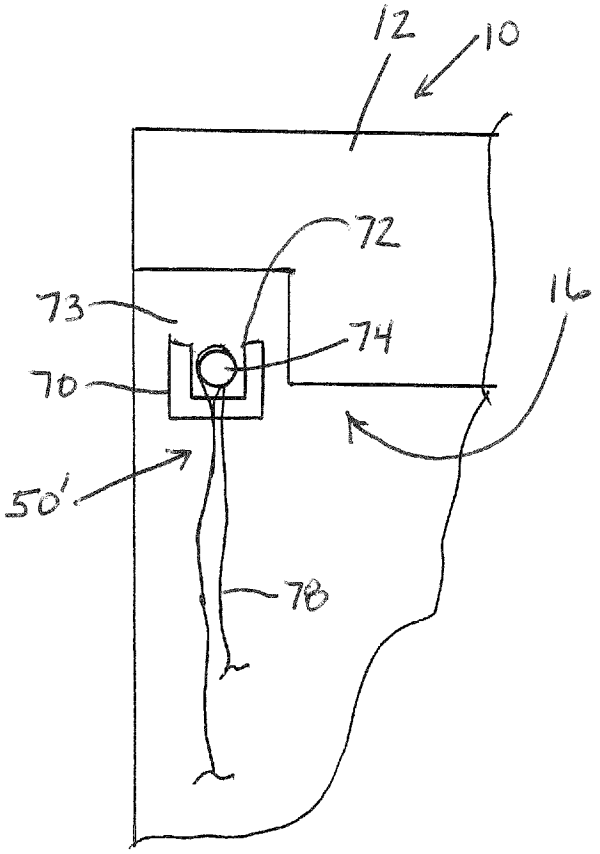
FIG. 2 is a partial schematic side view of one curtain mount amount configuration.
Figure 4:
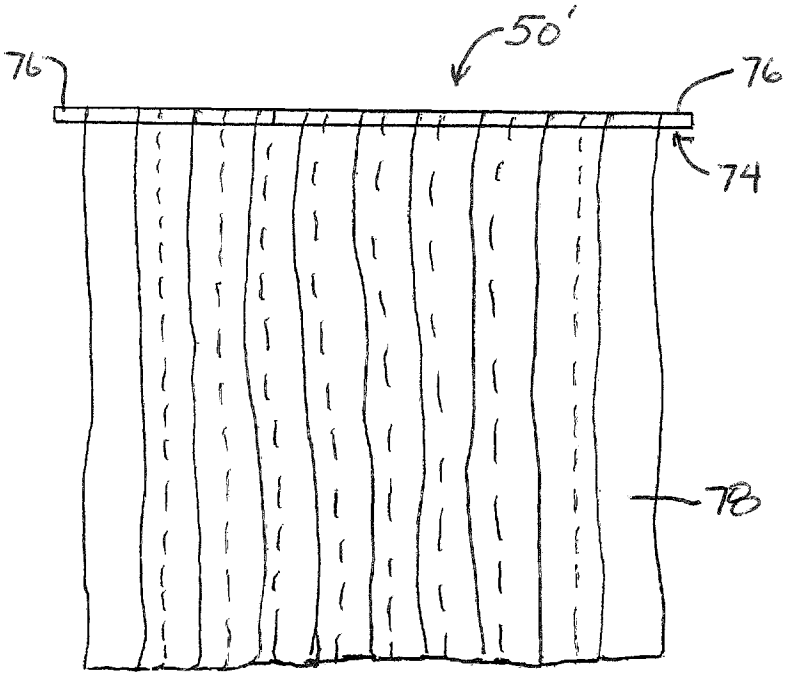
FIG. 4 is a front plan view of one curtain structure embodiment.

FIG. 2 shows exemplary curtain mount configuration, which enables the curtain structure to be removed from the machine 10 if desired. In the embodiment of FIG. 2, the mount structure is formed by a pair of opposed mount brackets 70 (only one shown in this side view) that are mounted on the housing 12 (at left and right internal side wall portions 73 of the housing adjacent the chamber access opening 16). Each mount bracket includes an upwardly facing mount slot 72 into which end portions of an elongated rigid upper mount part 74 of a curtain structure 50' slide. Thus, the curtain structure can be removed, without requiring any tools, by simply moving the end portions of the mount part 74 upward and clear of the slots 72, and the moving the curtain structure forward and out of the machine. Here, the mount part 74 is an elongated metal rod, but other variations are possible. FIG. 4 shows a plan view of the curtain structure 50' of this type, with end portions 76 of the rigid part 74 exposed to enable the mounting. The rod 74 may simply slide through an upper looped portion of the flexible strip material 78 of the curtain structure 50', where the overlap and layering of the strip material is depicted by the dashed lines in FIG. 4. In this arrangement, where rigid part 74 is a rod, the overall curtain structure 50' is considered pivotably mounted to the housing because the rod can pivot within the slots 72.

Figure 3:
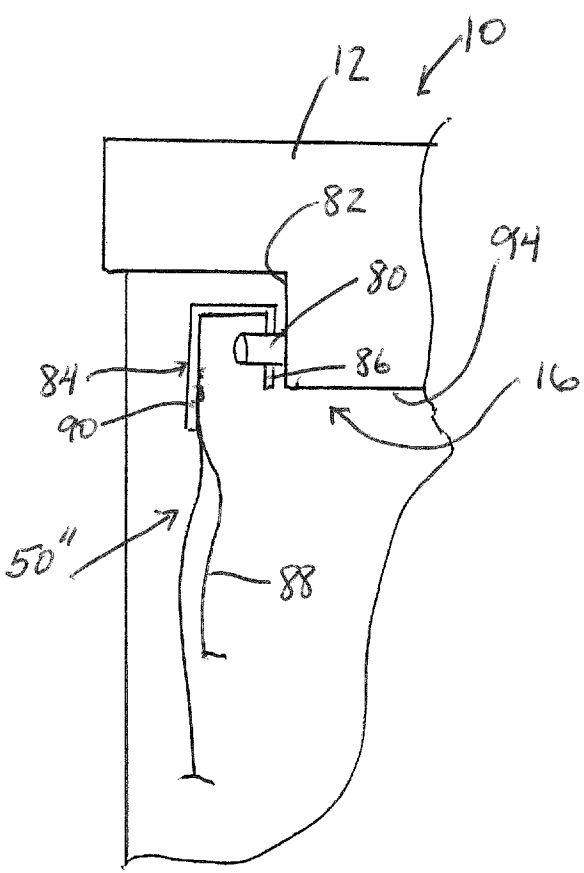
FIG. 3 is a partial schematic side view of another curtain mount configuration.
Figure 5:
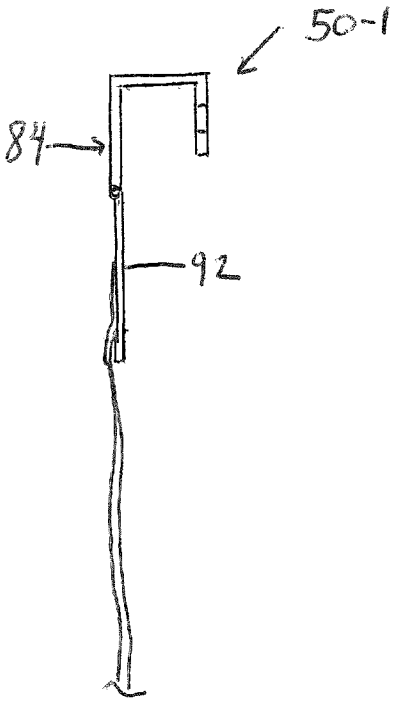
FIG. 5 is a partial side elevation of another curtain structure embodiment.

FIG. 3 shows another exemplary curtain mount configuration in which multiple mount studs or buttons 80 protrude forwardly from a forward facing internal housing wall portion 82 at the top of the chamber access opening 16. The curtain structure 50" includes an upper mount frame 84 with U-shape, where the rear flange 86 of the frame includes openings that align with the studs 80 for curtain mounting. The flexible strip material 88 of the curtain structure 50" is fixed to and extends downward from the forward flange 90 of the mount frame. In an alternative arrangement, as shown in FIG. 5, the curtain structure 50-1 has three (3) main parts in the form of a support frame 84 that attaches to the machine, a rigid curtain or stiff plate 92 (e.g., of translucent or transparent rigid plastic) and a flexible curtain strip material 88 (e.g., of multiple strands of translucent or transparent flexible plastic) mounted to rigid curtain or stiff plate 92. The rigid curtain or stiff plate 92 may serve as a pin point to help assure that the flexible strip material 88 moves back down into vertical position after ware loads are moved in and out of the chamber.

The flexible strip material (or other portions) of any of the above curtain configurations could be transparent or sufficiently translucent to enable some viewing of wares within the chamber, through the curtain. Of course, other materials could be used, including variations that are not translucent or transparent, with colors as desired (e.g., blue or other). As shown in the embodiment, the a top most portion of a curtain structure may be positioned at a height that is at or above a height of an upper wall 94 of the chamber.

Various features could be incorporated into the curtain structure, such as the removability mentioned above. Additional features could include the ability to pivot the curtain structure away from the access opening (e.g., to the right or to the left about a vertical axis), which may be useful for chamber access and cleaning. Where the curtain structure is removable, the machine may include one or more sensors and logic (e.g., via a controller 100) to detect whether the curtain is in place and provide an alert indication or query (e.g., on a machine user interface 102) if the curtain is not in place. As used herein, the term controller is intended to broadly encompass any circuit (e.g., solid state, application specific integrated circuit (ASIC), an electronic circuit, a combinational logic circuit, a field programmable gate array (FPGA)), processor(s) (e.g., shared, dedicated, or group—including hardware or software that executes code), software, firmware and/or other components, or a combination of some or all of the above, that carries out the control functions of the machine or the control functions of any component thereof. Typically a door closed sensor is also provided and such a controller is configured to implement a door interlock for shutting down or pausing an ongoing cleaning cycle when the door is moved away from the closed position. Although, the curtain alert could be implemented in a way to prevent cleaning cycles without the curtain place, in a more typical arrangement the controller would be configured such that cleaning cycles remain enabled even upon removal of the curtain structure (even though a curtain alert may be provided).

Figure 6:
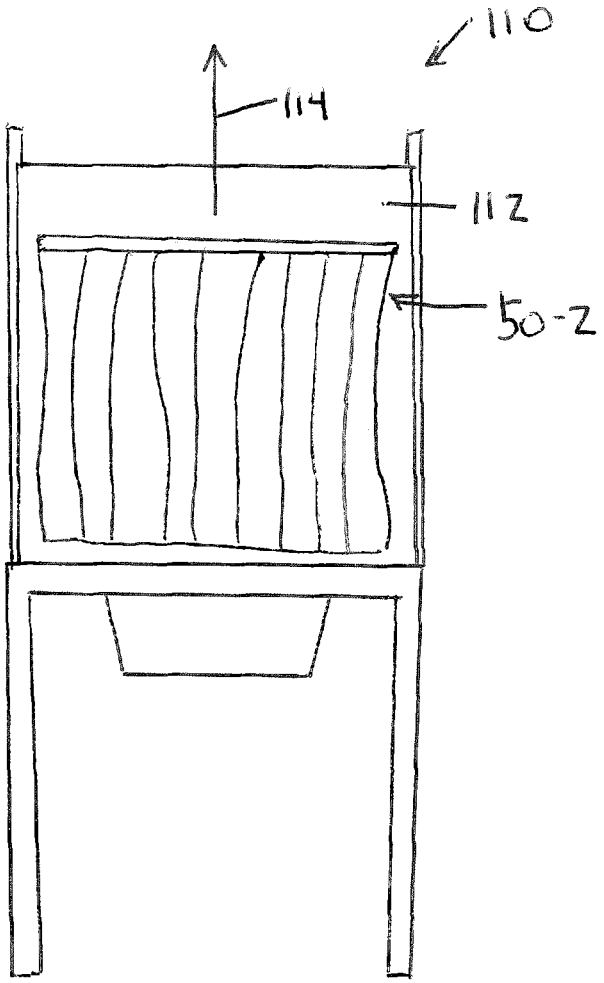
FIG. 6 shows a schematic front plan view of another warewash machine embodiment.

FIG. 6 provides a schematic side view of an alternative embodiment of a batch type machine 110 that includes a door 112 slidingly mounted to the machine housing for vertical movement up and down (per arrow 114) between open and closed positions. A curtain structure 50-2 is behind the door 110 and remains in position even when the door is moved upward to the open position. In some cases machines of this type include three sided-doors that move upward and downward, with the machine including corresponding left, right and front chamber access openings. In such machines, three curtain structures, one for each opening could be provided.

Notably, in the case of a machine 10 with a pivoting door, the curtain structure 50 lies or runs in a substantially vertical plane 120 that is substantially parallel to the pivot axis 122 of the door 18. In the case of machine 110 the curtain structure 50-2 lies or runs in a substantially vertical plane that is substantially parallel to a sliding plane of the door 112.

Test results have demonstrated that incorporating a curtain structure per above at the chamber access opening of a batch-type machine per the above embodiments meaningfully improved retention of heat within the machine over time as ware loads are moved in and out of the machine. The curtain structure aids in keeping the wash tank or sump water temperature above a desired minimum (e.g., of 150 F) as compared with the a baseline machine without the curtain. Overall, energy efficiencies of five percent or more are possible by incorporating a curtain structure. Moreover, the curtain structure also aids in the drying of wares once removed from the machine, as the wares themselves retain a higher thermal energy, which expedites the drying process. Overall, an increased ware thermal energy of eight percent or more is possible in certain machines. Moreover, hot air rolling out from the machine into the faces of operators when the machine door is opened is significantly reduced.

It is to be clearly understood that the above description is intended by way of illustration and example only and is not intended to be taken by way of limitation, and that changes and modifications are possible. Notably, it is possible for many existing batch-type machines to be retrofitted with curtain structures, by modifying the machines to include curtain mount structure (e.g., mount brackets) at the chamber access opening.

What is claimed is:

1. A batch-type warewash machine for washing wares, comprising:

a housing defining a chamber for receiving wares to be cleaned and having a chamber access opening through which wares are moved into and out of the chamber, the chamber including a lower sump zone and an upper spray zone, wherein the chamber access opening runs vertically along the housing;

a wash spray system including a pump and a wash liquid flow path for moving wash liquid from the sump along the wash liquid flow path to at least one wash spray arm with multiple wash spray nozzles for directing wash liquid sprays onto wares within the upper spray zone;

a rinse spray system including a rinse spray flow path for delivering rinse liquid to at least one rinse arm with multiple rinse spray nozzles for directing rinse liquids sprays onto wares within the upper spray zone;

a door mounted to the housing, the door movable between a closed position covering the chamber access opening and an open position away from the chamber access opening to allow wares to be moved in and out of the chamber, wherein the door is in a vertical orientation when in the closed position; and a curtain structure mounted on the housing at the chamber access opening, the curtain structure positioned alongside a back side of the door when the door is in the closed position, the curtain structure at least partially covering an upper part of the chamber access opening when the door is in the open position, the curtain structure comprising flexible material that enables wares to be moved in and out of the chamber access opening past the curtain structure;

wherein the chamber lacks any opening, other than the chamber access opening, through which wares can be moved into and out of the chamber;

wherein the chamber lacks any ware conveyance structure that moves wares during cleaning cycles; and wherein the chamber lacks any spray zone, other than the upper spray zone, and both wash liquid sprays and rinse liquid sprays are directed onto wares that are stationary within the upper spray zone.

2. The machine of claim 1 wherein the curtain structure includes an upper rigid portion and a lower flexible portion that incorporates the flexible material.

3. The machine of claim 1 wherein the curtain structure extends downward from an upper position proximate an upper edge of the chamber access opening to a lower position proximate a bottom edge of the chamber access opening.

4. The machine of claim 1 wherein the curtain structure extends downward from an upper position proximate an upper edge of the chamber access opening and terminates at a lower position that is higher than a bottom edge of the chamber access opening by at least four inches.

5. The machine of claim 1 wherein the flexible material comprises overlapping elongated strips of flexible material.

6. The machine of claim 1 wherein a bottom portion of the door is pivotably mounted to the housing such that the door pivots downward in order to move from the closed position, which is an upright position, to the open position which is a lateral position.

7. The machine of claim 1 wherein the door is slidingly mounted to the housing and shifts upward when moving from the closed position to the open position, and both the closed position and the open position are upright positions.

8. The machine of claim 1 wherein the curtain structure includes an upper mount frame, an intermediate rigid part extending downward from the upper mount frame and a lower flexible part extending downward from the intermediate rigid part.

9. The machine of claim 1 wherein a substantial majority of the curtain structure is comprised of transparent or at least translucent to enable some viewing of wares within the chamber from a position external of the machine when the door is in the open position.

10. The machine of claim 1 wherein the curtain structure is pivotably mounted to the housing.

11. The machine of claim 1 wherein the curtain structure is removable from the machine without the use of tools.

12. The machine of claim 1 wherein the curtain structure includes an elongated rigid upper mount part with end portions that slide down into opposed mount bracket slots on the housing.

13. The machine of claim 1 wherein a top most portion of the curtain structure is positioned at a height that is at or above a height of an upper wall of the chamber.

14. A batch-type warewash machine for washing wares, comprising:

a chamber for receiving wares to be cleaned, the chamber having a chamber access opening and a single spray zone, with at least one spray system for spraying liquid onto wares in the single spray zone, wherein the chamber access opening runs vertically, wherein the chamber lacks any ware conveyance structure that moves wares during cleaning cycles;

a door movable between a closed position covering the chamber access opening and an open position away from the chamber access opening to allow wares to be moved in and out of the chamber, wherein the door is in a vertical orientation when in the closed position;

a curtain structure mounted on the machine, the curtain structure located behind and adjacent a back side of the door when the door is in the closed position, the curtain structure remaining in position and at least partially covering the chamber access opening when the door is in the open position so as to retain hot moist air within the chamber when the door is moved to the open position upon completion of a ware cleaning cycle.

* * * * *